US006739698B2

(12) United States Patent
Benson et al.

(10) Patent No.: US 6,739,698 B2
(45) Date of Patent: May 25, 2004

(54) OFF-CARRIER TUBING LAYOUT

(75) Inventors: Michael James Benson, Lexington, KY (US); Johnnie A. Coffey, Winchester, KY (US); Brian Dale Cook, Nicholasville, KY (US); David Wayne DeVore, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/241,164

(22) Filed: Sep. 11, 2002

(65) Prior Publication Data

US 2004/0046840 A1 Mar. 11, 2004

(51) Int. Cl.[7] ..... B41J 23/00
(52) U.S. Cl. ..... 347/37
(58) Field of Search ..... 347/37, 85, 86, 347/87, 104

(56) References Cited

U.S. PATENT DOCUMENTS

| | | | |
|---|---|---|---|
| 4,394,669 | A | 7/1983 | Ozawa et al. |
| 4,513,297 | A | 4/1985 | Okamura |
| 4,684,962 | A | 8/1987 | Hirosawa et al. |
| 4,702,281 | A | 10/1987 | Moritz |
| 4,775,868 | A | 10/1988 | Sugiura |
| 4,775,871 | A | 10/1988 | Abe et al. |
| 5,025,270 | A | 6/1991 | Umezawa |
| 5,043,746 | A | 8/1991 | Abe |
| 5,096,316 | A | 3/1992 | Otsuka et al. |
| 5,194,015 | A | 3/1993 | Yamamoto et al. |
| 5,469,201 | A | 11/1995 | Erickson et al. |
| 5,883,646 | A | 3/1999 | Beauchamp |
| 5,905,512 | A | 5/1999 | Beauchamp |
| 5,992,970 | A | 11/1999 | Unosawa et al. |
| 6,068,370 | A | 5/2000 | Miller et al. |
| 6,196,660 | B1 | 3/2001 | Park |
| 2002/0034410 | A1 | 3/2002 | Bartolome et al. |

FOREIGN PATENT DOCUMENTS

| | | | |
|---|---|---|---|
| JP | 1095060 | A | 4/1989 |
| JP | 6015919 | A | 1/1994 |

*Primary Examiner*—Anh T.N. Vo
(74) *Attorney, Agent, or Firm*—Taylor & Aust. P.C.

(57) ABSTRACT

An ink jet printer includes a frame, at least one flexible ink tube and a trough connected to the frame. The trough has a longitudinal length oriented in a first direction and a planar ink tube receiving portion oriented at an acute angle from a vertical axis. At least a portion of the flexible ink tube is disposed along at least a portion of the planar ink tube receiving portion.

30 Claims, 3 Drawing Sheets

OFF-CARRIER TUBING LAYOUT

BACKGROUND OF THE INVENTION

1. Field of the Invention

The present invention relates to an imaging device, and, more particularly, to a tubing layout for an ink jet printer having an off-carrier system.

2. Description of the Related Art

Ink jet printers are well known. One common type of ink jet printer uses a replaceable print cartridge having a printhead and a supply of ink contained within the cartridge. The printhead is installed in a printhead carrier, which positions the printhead along a printing zone. When the supply of ink contained within the print cartridge is depleted, the print cartridge is disposed and a new print cartridge is installed in the printhead carrier. In contrast, a continuous ink refill system delivers ink through supply tubes from a refillable off-carrier ink supply tank to an ink jet printhead positioned on the printhead carrier.

Constant fluid communication between the ink tank and the printhead is maintained by way of flexible tubes. The flexible tubes may be singular for a single color printhead or there may be multiple tubes disposed in a parallel manner to supply multiple colors of ink to a multi-color printhead. As the ink supply is depleted, needed ink is replaced in the ink tank by the operator, thereby renewing the ink supply in the off-carrier system.

As the printhead traverses the print area, printing ink on a print medium, such as paper, the flexible tubes move along with the printhead causing the tubes to variously curve and flex.

One problem with flexing ink supply tubes is that a considerable amount of vertical room is needed to accommodate the flexing and curved connections of the tubes to the printhead.

What is needed in the art is an apparatus that reduces the vertical displacement of flexible ink tubes.

SUMMARY OF THE INVENTION

The present invention provides an apparatus for guiding and partially restraining flexible ink tubing of off-carrier type printers.

The invention, in one form thereof, is directed to an ink jet printer including a frame, at least one flexible ink tube and a trough connected to the frame. The trough has a longitudinal length oriented in a first direction and a planar ink tube receiving portion oriented at an acute angle from a vertical axis. At least a portion of the flexible ink tube is disposed along at least a portion of the planar ink tube receiving portion.

The invention, in another form thereof, is directed to an ink jet printer mid-frame assembly including a mid-frame, a mid-frame upper portion connected to the mid-frame for mounting a plurality of star wheels and an ink tubing trough having an edge portion connected to the mid-frame upper portion. The ink tubing trough having a planar ink tube receiving portion.

The invention, in yet another form thereof, is directed to a method of supporting a flexible ink tubing in an ink jet printer including the steps of: providing an ink tubing trough having an edge portion connected to a mid-frame upper portion; orienting a planar ink tube receiving portion of the ink tubing trough at an acute angle from a vertical axis; and directing the flexible ink tubing to contact the planar ink tube receiving portion as a printhead is repositioned in the ink jet printer.

The invention, in yet still another form thereof, is directed to an ink jet printer including a mid-frame for supporting a sheet of print medium, a mid-frame upper portion connected to the mid-frame, the mid-frame upper portion mounting a plurality of star wheels and an ink tubing trough connected to the mid-frame upper portion, the ink tubing trough having a planar ink tube receiving portion.

An advantage of the present invention is that the flexible tubing that supplies ink to an ink printhead has a reduced vertical travel thereby enhancing the transport of ink.

Another advantage of the present invention is that the tubing trough coacts with the mid-frame upper portion to provide additional strength thereto, thereby enhancing the flatness of the print media during printing.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
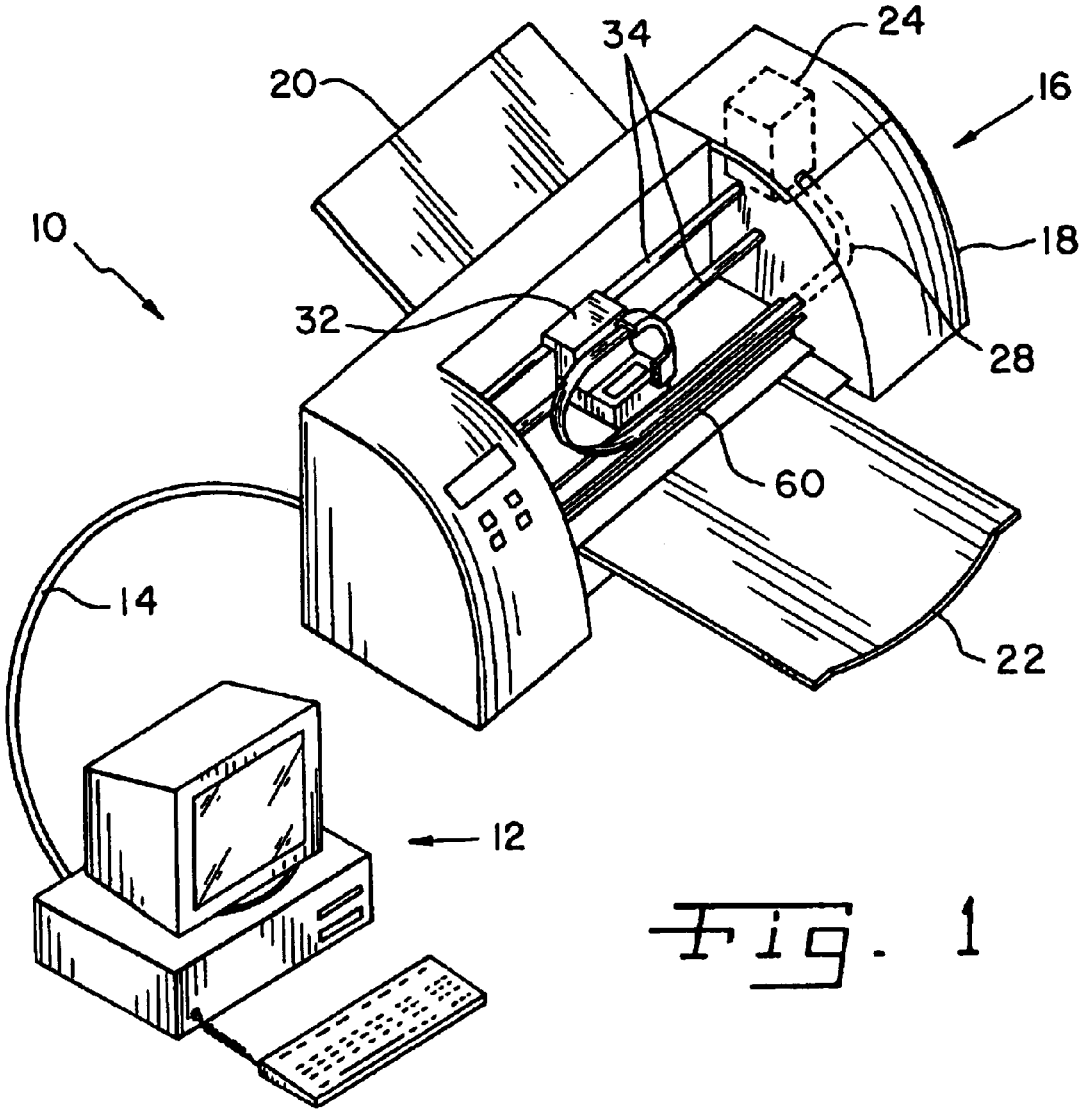
FIG. 1 is an ink jet printer incorporating an embodiment of an off-carrier tubing layout of the present invention.
Figure 2:
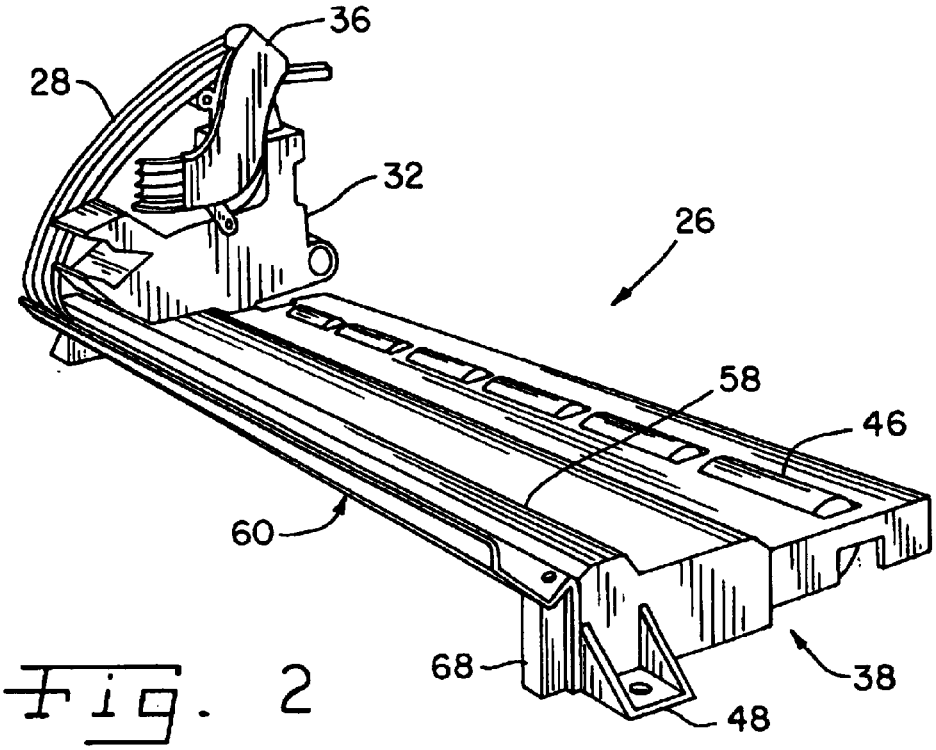
FIG. 2 is a perspective view of a mid-frame assembly and a carrier assembly used in the ink jet printer of FIG. 1.

Referring now to the drawings, and more particularly to FIG. 1, there is shown a perspective view of an imaging system 10 including a computer 12, a communication link 14 and an ink jet printer 16. Computer 12 is interconnected with ink jet printer 16 by way of communication link 14. Communication link 14 can be a point-to-point electrical cable connection between either serial or parallel ports of ink jet printer 16 and computer 12 or the connection can be by way of a network connection such as an Ethernet network.

Ink jet printer 16 includes a printer frame 18, a paper feed tray 20, a paper exit tray 22, an ink tank receiver 24 for holding an ink tank and a mid-frame/printhead carrier assembly 26. Printer frame 18 provides structural integrity to, and the mounting points for the mechanisms contained within ink jet printer 16. Paper feed tray 20 is connected to printer frame 18 allowing for the feeding of paper into ink jet printer 16. Paper exit tray 22 is positioned to receive paper that has been printed by printer 16. Paper exit tray 22 is connected to printer frame 18 for the receiving of paper from ink jet printer 16. Ink tank receiver 24 is configured for receiving ink supplies and providing ink therefrom by way of tubing assembly 28 to printhead 30.

Now, additionally referring to FIGS. 2–5, there is illustrated mid-frame/printhead carrier assembly 26 including a tubing assembly 28, a printhead 30, a carrier 32, a manifold 36 and a mid-frame assembly 38. Tubing assembly 28 includes tubes 40 and sleeving 42. Tubes 40 are flexible tubes for conveying ink from ink tank receiver 24 to printhead 30 by way of manifold 36. Tubes 40 are arranged in a parallel fashion and are held in position by sleeve 42. Sleeve 42 is made of a flexible polymer having ribs thereon. The ribs reduce physical deterioration of tubes 40 and influence the flexible movement of tubing assembly 28.

Printhead 30 includes multiple nozzles, at least one nozzle for each color of ink. Nozzles may alternate in size along an axis of printhead 30 and have a fixed pitch of $1/600^{th}$ of an inch. Printhead 30 is in fluid communication with ink tank receiver 24 by way of tubing assembly 28 and manifold 36. Printhead 30 is held in place on carrier 32 which positions printhead 30 for the delivery of ink droplets to a print medium such as paper. Carrier 32 is transported in a bi-directional fashion by a motorized drive system (not shown) and is supported by carrier support rod 34. Manifold 36 is connected to carrier 32. Manifold 36 is fluidly connected to tubing assembly 28 and directs ink to printhead 30.

Mid-frame assembly 38 includes a mid-frame 44, an index roller 46, mounting feet 48, an exit roller 50, star wheels 52, axial mounts 54, retention arms 56, a mid-frame upper portion 58, and a tubing trough 60. Mid-frame 44 provides structural integrity to the lower part of mid-frame assembly 38, particularly the portion beneath the paper feed area. Mid-frame 44 may be made of plastic, being formed by a plastic injection molding process, and contains mounting points for index roller 46 and exit roller 50. Mounting feet 48 are attached to mid-frame 44 and may be integral with mid-frame 44 extending downward to mounting points on printer frame 18. Mounting feet 48 extend upward to provide support to mid-frame upper portion 58 and tubing trough 60. Mid-frame 44 has a paper path P substantially normal to a vertical axis X, through which paper 76 travels.

Index roller 46 is located below the area in which paper is fed and assists in the movement of paper towards a printing area. Exit roller 50 is positioned downstream of the printing area and coacts with star wheels 52 for the movement of paper through printer 16. Exit roller 50 may be embodied as a series of rubber rollers on a single shaft separated to coact with corresponding star wheels 52. Exit roller 50 is driven by an electric motor (not shown). Rubber portions of exit roller 50 grips the non-printed side of the paper and star wheels 52 are in contact with the printed surface of the paper. Star wheels 52 are each rotatably mounted on a corresponding axial mount 54. Axial mounts 54 are a coiled spring that is retained in retention arm 56 by pressure from axial mount 54 and by the physical contact of star wheels 52 with exit roller 50. Retention arms 56 are structurally attached to mid-frame upper portion 58, which may be integrally formed as a part of mid-frame upper portion 58. Each retention arm 56 has a slot in which a corresponding star wheel 52 freely rotates. Tubing trough 60 is attached to mid-frame upper portion 58 at an acute angle 74 from vertical axis X, thereby advantageously strengthening mid-frame upper portion 58 supporting star wheels 52, as well as positioning tubing trough 60 for guiding, holding, receiving and relinquishing tubing assembly 28 as carrier 32 and printhead 30 move.

Figure 3:
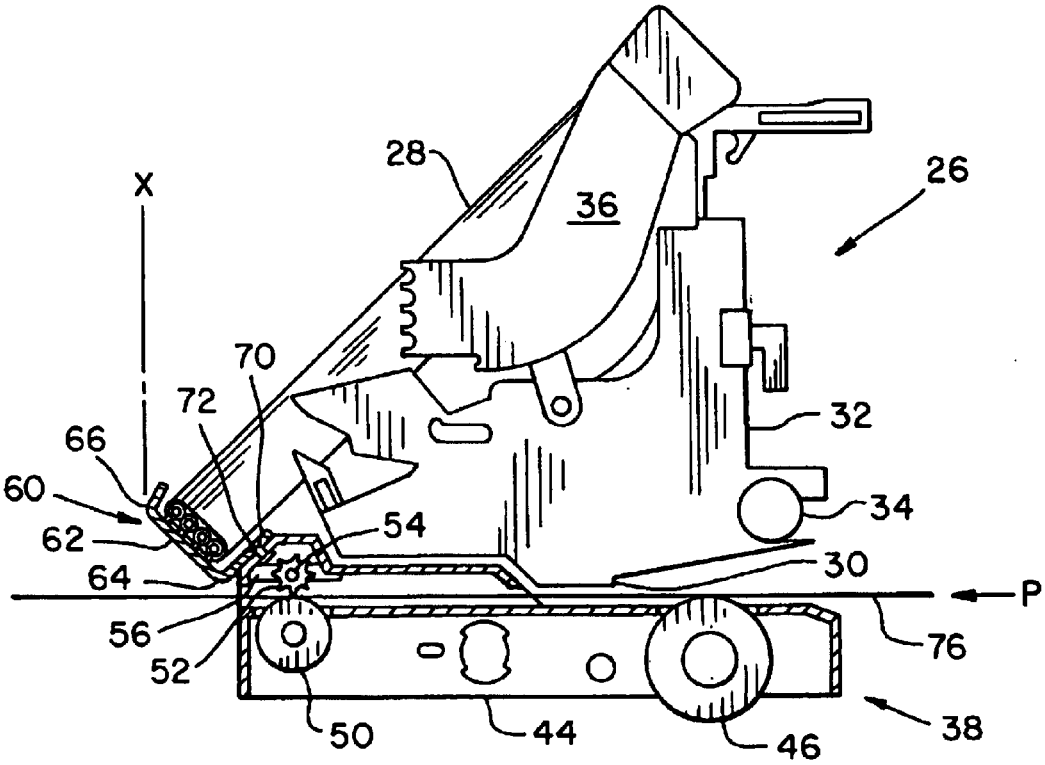
FIG. 3 is a partially sectioned side view of the mid-frame assembly and the carrier assembly of FIG. 2.
Figure 4:
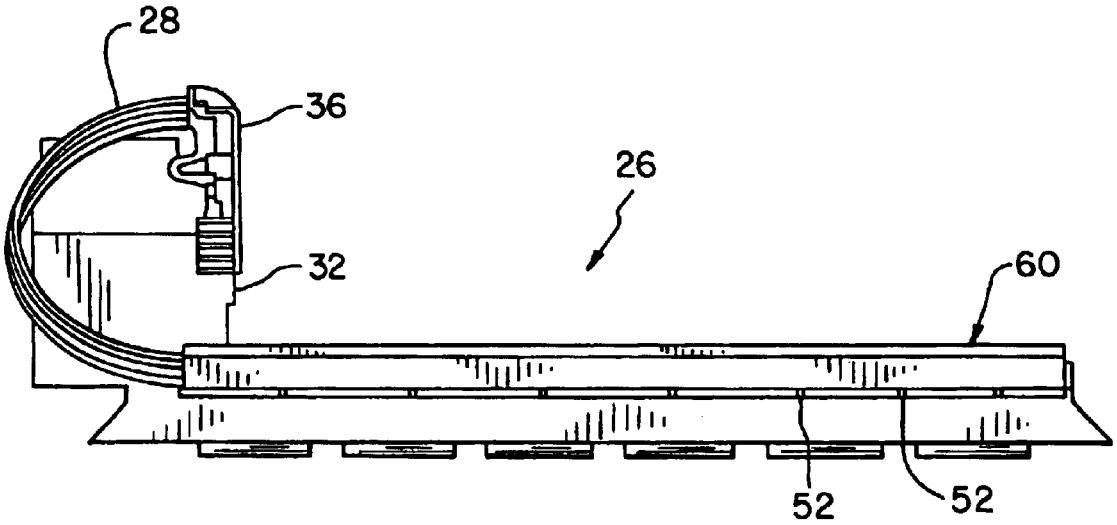
FIG. 4 is a front view of the mid-frame assembly and printhead carrier assembly of FIGS. 2 and 3.
Figure 5:
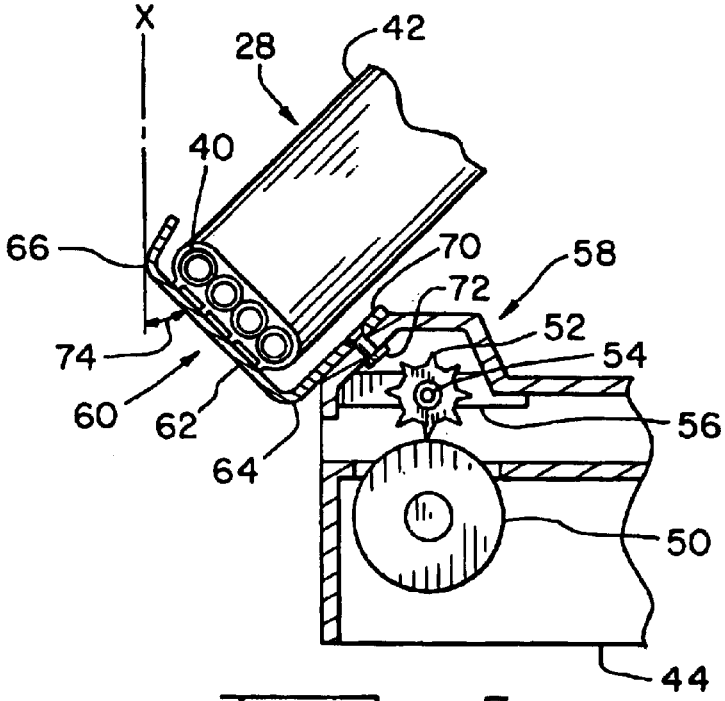
FIG. 5 is a cross-sectional view of a portion of the mid-frame assembly used in the printer of FIG. 1 and the assemblies of FIGS. 2–4.

Tubing trough 60 includes a planar portion 62, a lower curved portion 64, an upper curved portion 66, end supports 68 and an edge portion 70. Tubing trough 60 is attached to mid-frame upper portion 58 by way of protrusions, adhesive or fasteners 72. Tubing trough 60 is an elongated trough having a longitudinal length orientated in a substantially horizontal direction and substantially parallel with carrier support rod 34. Planar portion 62, also known as planar ink tube receiving portion 62, is positioned to receive and relinquish a portion of ink tubing assembly 28 as it is moved by carrier 32. The width of tubing trough 60, which is transverse to the longitudinal length, is orientated at acute angle 74 from vertical axis X (see FIG. 5). Preferably, acute angle 74 of tubing trough 60 may be approximately 20° to approximately 70° from vertical, or more specifically between approximately 40° and approximately 50°. In a preferred embodiment of the present invention acute angle 74 is approximately 45° as shown in FIGS. 3 and 5. The advantage of positioning tubing trough 60 at an acute angle to the vertical includes the reduction in vertical movement of ink in tubing assembly 28 versus a tubing trough that is positioned at 90° from vertical. Another advantage is that the 45° arrangement of tubing trough 60 and thus the angled alignment of tubing assembly 28 is that it reduces the overall profile needed for an off-carrier ink jet system.

As previously discussed, planar portion 62 is at approximately 45° from vertical axis X, which positions edge portion 70, which interfaces with a portion of mid-frame upper portion 58 at approximately a 45° angle on the opposite side of vertical axis X hence the angle between edge portion 70 and planar portion 62 approximates 90°. Planar portion 62 is sized to accommodate the movement of tubing assembly 28. As carrier 32 traverses carrier support rod 34, tubing assembly 28 flexibly follows the movement of carrier 32. As carrier 32 moves, tubing assembly 28 is removed from, or received by, tubing trough 60 and repositioned based on the position of carrier 32. The natural flexibility and resiliency of tubing assembly 28 facilitates such movement. Lower curved portion 64 and upper curved portion 66 have a radius that approximates the radius of tubing assembly 28 to thereby provide a non-pinching, yet restraining, contact surface for tubing assembly 28. In addition, lower curved portion 64 and upper curved portion 66 provide structural strength to tubing trough 60. End supports 68 are connected to ends of tubing trough 60. End supports 68 interface with mounting feet 48 to provide structural strength to and maintain the angular position of tubing trough 60. Edge portion 70 is connected with a surface of mid-frame upper portion 58 thereby strengthening and making more rigid mid-frame upper portion 58. Edge portion 70 is connected to mid-frame upper portion 58 by way of fasteners 72 or by other suitable connecting mechanisms. Alternatively, tubing trough 60 may be formed integral with mid-frame upper portion 58.

The positioning and fastening of tubing trough 60 to mid-frame upper portion 58 allows tubing trough 60 to coact with mid-frame upper portion 58 to increase the rigidity and straightness of mid-frame upper portion 58, thereby assisting in holding retention arms 56 in a fixed relationship with respect to mid-frame 44. In turn, axial mounts 54 are held in a substantially aligned manner thereby positioning star wheels 52 in substantial alignment with each other. The advantageous result of the substantial alignment of star wheels 52 facilitates the accurate repeatable movement of paper through printer 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer, comprising:

a frame;

at least one flexible ink tube; and a trough connected to said frame, said trough having a longitudinal length oriented in a first direction and a planar ink tube receiving portion oriented at an acute angle from a vertical axis, at least a portion of said at least one flexible ink tube disposed along at least a portion of said planar ink tube receiving portion.

2. The ink jet printer of claim 1, further comprising:

at least one carrier support connected to said frame;

a carrier movably disposed on said at least one carrier support; and at least one printhead disposed in said carrier, said at least one printhead in fluid communication with a corresponding at least one said flexible ink tube.

3. The ink jet printer of claim 2, wherein said first direction of said trough is substantially parallel with said at least one carrier support.

4. The ink jet printer of claim 1, further comprising at least one ink tank in fluid communication with a corresponding one of said at least one flexible ink tube.

5. The ink jet printer of claim 1, wherein said trough further comprises an edge portion along said length of said trough.

6. The ink jet printer of claim 5, further comprising a mid-frame upper portion connected to said edge portion of said trough.

7. The ink jet printer of claim 6, further comprising:

a plurality of axial mounts connected to said mid-frame upper portion; and a plurality of star wheels each rotatably disposed on a corresponding one of said axial mounts.

8. The ink jet printer of claim 7, wherein said edge portion is substantially perpendicular to said planar ink tube receiving portion, said trough co-acting with said mid-frame upper portion to hold said plurality of axial mounts in substantial alignment with each other.

9. The ink jet printer of claim 6, further comprising at least one end support being connected to at least one of an end of said mid-frame upper portion and an end of said trough.

10. The ink jet printer of claim 1, wherein said acute angle is greater than approximately 20° and less than approximately 70°.

11. The ink jet printer of claim 10, wherein said acute angle is greater than approximately 40° and less than approximately 50°.

12. The ink jet printer of claim 11, wherein said acute angle is approximately 45°.

13. An ink jet printer mid-frame assembly, comprising:

a mid-frame;

a mid-frame upper portion connected to said mid-frame for mounting a plurality of star wheels; and an ink tubing trough having an edge portion connected to said mid-frame upper portion, said ink tubing trough having a planar ink tube receiving portion.

14. The assembly of claim 13, wherein said mid-frame has a paper path substantially normal to a vertical axis, said planar ink tube receiving portion oriented at an acute angle to said vertical axis.

15. The assembly of claim 14, wherein said acute angle is greater than approximately 20° and less than approximately 70°.

16. The assembly of claim 15, wherein said acute angle is greater than approximately 40° and less than approximately 50°.

17. The assembly of claim 16, wherein said acute angle is approximately 45°.

18. The assembly of claim 13, further comprising a plurality of retention arms connected to said mid-frame upper portion, said plurality of star wheels each rotatably mounted to a corresponding one of said plurality of retention arms.

19. The assembly of claim 18, wherein said edge portion is substantially perpendicular to said planar ink tube receiving portion, said ink tubing trough co-acting with said mid-frame upper portion to hold said plurality of star wheels in substantial alignment with each other.

20. The assembly of claim 13, further comprising at least one end support being connected to at least one of an end of said mid-frame upper portion and an end of said ink tubing trough.

21. A method of supporting flexible ink tubing in an ink jet printer, comprising the steps of:

providing an ink tubing trough having an edge portion connected to a mid-frame upper portion;

orienting a planar ink tube receiving portion of said ink tubing trough at an acute angle from a vertical axis; and directing the flexible ink tubing to contact said planar ink tube receiving portion as a printhead is positioned in the ink jet printer.

22. The method of claim 21, wherein said acute angle is greater than approximately 20° and less than approximately 70°.

23. The method of claim 22, wherein said acute angle is greater than approximately 40° and less than approximately 50°.

24. An ink jet printer, comprising:

a mid-frame for supporting a sheet of print medium;

a mid-frame upper portion connected to said mid-frame, said mid-frame upper portion mounting a plurality of star wheels; and an ink tubing trough connected to said mid-frame upper portion, said ink tubing trough having a planar ink tube receiving portion.

25. The ink jet printer of claim 24, wherein said mid-frame has a paper path substantially normal to a vertical axis, said planar ink tube receiving portion oriented at an acute angle to said vertical axis.

26. The ink jet printer of claim 25, wherein said acute angle is greater than approximately 20° and less than approximately 70°.

27. The ink jet printer of claim 26, wherein said acute angle is greater than approximately 40° and less than approximately 50°.

28. The ink jet printer of claim 27, wherein said acute angle is approximately 45°.

29. The ink jet printer of claim 24, further comprising a plurality of retention arms connected to said mid-frame upper portion, said plurality of star wheels each rotatably mounted to a corresponding one of said plurality of retention arms.

30. The ink jet printer of claim 29, wherein said edge portion is substantially perpendicular to said planar ink tube receiving portion, said ink tubing trough co-acting with said mid-frame upper portion to hold said plurality of star wheels in substantial alignment with each other.

* * * * *